US005114361A

United States Patent [19]

Houtteman

[11] Patent Number: 5,114,361

[45] Date of Patent: May 19, 1992

[54] ARRESTING MECHANISM/LOCK FOR COAXIAL PLUG CONNECTORS

[75] Inventor: Bernard Houtteman, Oostkamp, Belgium

[73] Assignee: Siemens Aktiengesellschaft, Berlin and Munich, Fed. Rep. of Germany

[21] Appl. No.: 777,431

[22] Filed: Oct. 11, 1991

Related U.S. Application Data

[63] Continuation of Ser. No. 568,016, Aug. 16, 1990, abandoned.

[30] Foreign Application Priority Data

Sep. 11, 1989 [DE] Fed. Rep. of Germany .. 8910843[U]

[51] Int. Cl.[5] ..... H01R 4/50

[52] U.S. Cl. ..... 439/348; 439/839

[58] Field of Search ..... 439/345-349, 439/818, 819, 823, 827, 125-128, 839

[56] References Cited

U.S. PATENT DOCUMENTS

| | | | |
|---|---|---|---|
| 3,237,147 | 2/1966 | Elliott et al. | 439/348 |
| 3,813,645 | 5/1974 | Elliott et al. | 439/839 |
| 4,762,504 | 8/1988 | Michaels et al. | 439/345 |
| 4,824,386 | 4/1989 | Saunders | 439/348 |

FOREIGN PATENT DOCUMENTS

| | | |
|---|---|---|
| 10433 | 7/1966 | Fed. Rep. of Germany . |
| 2143434 | 3/1973 | Fed. Rep. of Germany . |

*Primary Examiner*—Larry I. Schwartz
*Assistant Examiner*—Hien D. Vu
*Attorney, Agent, or Firm*—Hill, Van Santen, Steadman & Simpson

[57] ABSTRACT

Arresting mechanism for coaxial plug connectors. Balls which sit in radial borings of a protective sleeve are kept in a lock-in position by a circularly bent spring that is locked in an outside surrounding flat groove of the protective sleeve. Only on one end is the slotted band spring secured against rotation in the flat groove by indentations provided in the border of the groove.

5 Claims, 1 Drawing Sheet

ARRESTING MECHANISM/LOCK FOR COAXIAL PLUG CONNECTORS

This is a continuation of application Ser. No. 568,016, filed Aug. 16, 1990 now abandoned.

BACKGROUND OF THE INVENTION

The present invention is directed to an arresting mechanism for a coaxial plug connector composed of two plug connector halves that can be plugged into each other, whereby an outer conductor sleeve of a first plug connector half is provided in a front section on the outside with a surrounding groove, and the second plug connector half has a receiving space between an outside rigid protective sleeve and an outer conductor sleeve into which the front section of the outer conductor sleeve of the first plug connector half can be inserted, whereby at least one ball held in a stepped radial boring of the protective sleeve is provided such that it engages the surrounding groove.

An arresting mechanism of this type is known from the German reference DE 19 51 180 U1. In the case of this known arresting mechanism a sliding sleeve surrounding the protective sleeve is provided which can be moved against a spring force in an axial direction. Thereby, the arresting balls previously seated in their bores are freed so that the plug connector halves can be freely plugged together. If the sliding sleeve is moved back into its starting position, it keeps the balls in a position in which they are engaged with the all-around groove of the other plug connector half. The two plug connector halves are thus connected with each other in a non-detachable fashion and only if the sliding sleeve is moved again are the balls released so that they can outwardly retreat and thus allow the two plug connector halves to be pulled apart.

Many coaxial plug connectors simply require, to secure the connection of the plug connector halves, only restraining forces which do not exceed a certain level. In these cases, no arresting mechanism is necessary; it can be accepted that the plugged-in connection is disrupted under the impact of higher forces.

SUMMARY OF THE INVENTION

It is an object of the present invention to provide an arresting mechanism of the initially described type such that, given an optimally simple construction, a dependable connection of the plug connector halves in a plugged-in condition is guaranteed as long as the occurring tension forces do not surpass a certain level.

According to the present invention, the problem is solved in that the stepped bore of the protective sleeve goes over into an all-around flat groove or slot (open towards the outside of the protective sleeve) of the protective sleeve, and that in this flat groove a circularly bent band spring is placed which supports itself at the ball and is interrupted at one location.

If the balls and the all-around groove of the first plug connector half, into which the balls reside in the plugged-together condition of the plug connector halves, are dimensioned such that the balls mainly support themselves at the edges of the groove, the result is a relatively good mechanical and electrical contact (due to the permanent elastic pressure of the balls) between the balls and the outer conductor sleeve of the first plug connector half.

In a further embodiment of the present invention, it can be provided that the band spring is fastened in the flat groove by indentations in the border of the flat groove, in particular in that merely two oppositely residing indentations are provided at the level of one end of the band spring.

In this manner, the band spring in the flat groove cannot move so that the interrupted location of the band spring can be kept outside of the openings of the radial bores in which the balls sit. Moreover, the location of the interrupted location on the one hand, and of the indentations on the other hand in relation to the radial bores can be designationally selected or adjusted such that a certain desired force is applied to the balls in the radial bores.

This system simultaneously causes an additional electrical path between the outer conductor contacts, which results in an increased HF-shielding/protection.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several figures in which like reference numerals identify like elements, and in which:

DESCRIPTION OF THE PREFERRED EMBODIMENT

Figure 1:
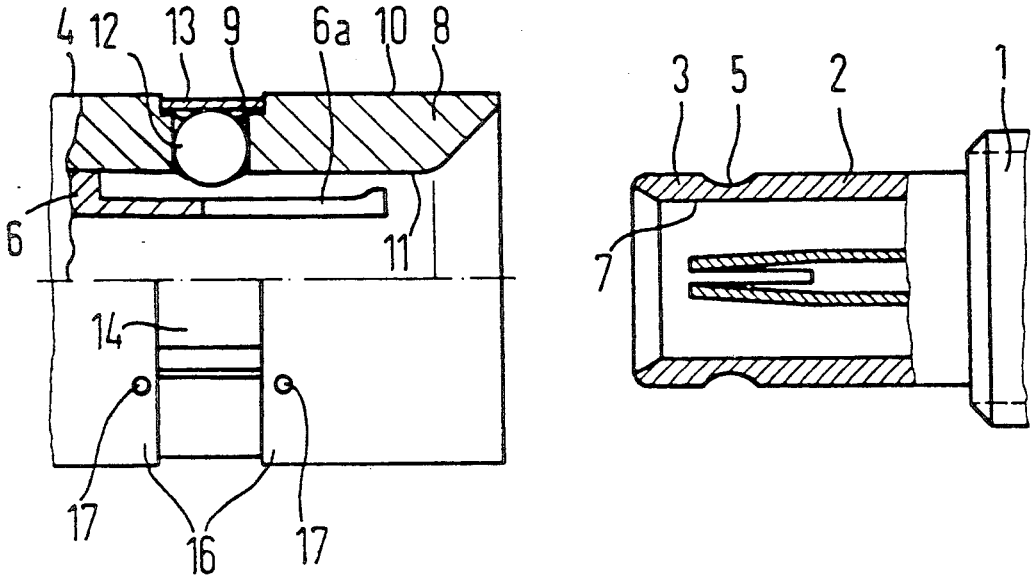
FIG. 1 depicts parts of the two plug connector halves as side views before being plugged together.
Figure 2:
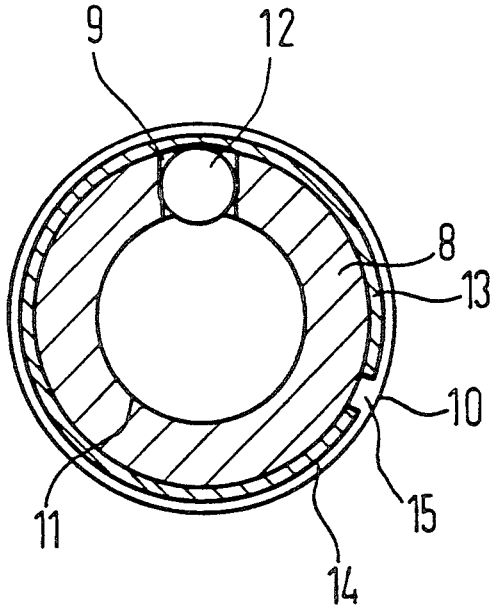
FIG. 2 depicts a cross-sectional view through the protective sleeve of the second plug connector half at the level of the radial bores, in which the balls sit whereby for the sake of clarity only one radial bore with one ball is shown.

FIGS. 1 and 2 disclose in detail that the coaxial plug connector has a first plug connector half 1, whereby an outer conductor sleeve 2, which is electrically connected with an outer conductor of a coaxial cable (not shown) is provided with an all-around groove 5 on the outside in a front section 3 facing the second plug connector half 4.

In the case of the second plug connector half 4, the outside conductor sleeve 6 is divided into spring tongues **6*a* by coaxial slots in a region facing the outer conductor sleeve 2 which are resiliently pressed against the inside 7 of the outside conductor sleeve 2 when the two plug connector halves 1, 4** are connected together.

In order to protect the tongues **6*a* the outside conductor sleeve 6 of the second plug connector half 4 is surrounded on the outside in the area of the tongues 6*a* by a protective sleeve 8 so that the outside conductor sleeve 2 of the first plug connector half can be inserted with its front section between the protective sleeve 8 and the tongues 6*a* when the two plug connector halves 1,4 are connected together. The protective sleeve 8 thereby guides the outside conductor sleeve 2 and in doing so prevents a canting of the sleeve 2 with the tongues 6*a***.

When the sleeve 2 with its front end 3 is completely inserted into the sleeve 8 the groove 5 is in a certain position relative to the sleeve 8. In the sleeve 8, at least one radial bore 9 is provided through the sleeve 8 such that this bore 9 has an axis aligned with the center of the groove 5.

Towards the outside 10 of the sleeve 8, the radial bore 9 has a larger diameter than towards the inside 11 of the sleeve 8. With the larger diameter, the bore 9 is sized to the diameter of a ball 12 which can be inserted into the bore 9 from the outside 10 of the sleeve 8. The smaller diameter of the bore 9 towards the inside 11 of the sleeve 8 thereby prevents the ball 12 from falling through to the inside. However, part of the circumference of the ball 12 (on the inside 11 of the sleeve 8) projects out of the sleeve and is pushed back by the sleeve 2 in the direction toward the outside 10 of the sleeve 8 when the sleeve 2 is inserted into the sleeve 8. Only when the groove 5 is located at the level of the bore 9, does the ball 12 emerge from the inside 11 of the sleeve 8 and locks into the groove 5. Thereby, the ball 12 no longer supports itself at the sleeve 8 particularly at a section of the bore 9 with the reduced diameter, but rather in a radial direction at the edge of the groove 5 and thus at the sleeve 2.

In this position, the ball 12 is firmly held by a circularly bent band spring 13, which is applied in a surrounding flat groove 14 incorporated on the outside of the sleeve 8 (FIG. 2).

The spring 13 supports itself at the ball 12 which projects from the bore 9 towards the outside 10 of the sleeve 8, and thus presses the ball 12 elastically towards the inside, whereby the ball 12 either supports itself at the section of the bore 9 which is reduced in diameter, or at the sleeve 2 in the area of the groove 5.

In the area of the interrupted location 15, the band spring 13 is slotted and can thus elastically expand when the ball 12 is pressed towards the outside from the sleeve 2 in the bore 9.

In order to prevent the interrupted location 15 of the band spring 13 from getting into the area of the ball 12, indentations 17 are provided in the border 16 of the groove 14 at two apposed locations. Due to these indentations 17, material of the sleeve 8 is laterally pressed against the band spring 13 and the band spring 13 is thus clamped in the groove 14 at the location of the indentations 17.

The interrupted location 15 and the indentations 17 are located at the place where the spring effect of the band spring 13 optimally fulfills the requirements.

A corresponding adjustment of the ball 12 and the groove 5 makes it possible to establish a good electrical connection between the sleeve 8 of the one plug connector half via the clamping-in of the spring 13 and via the ball 12 with the outside conductor sleeve 2 of the other plug connector half.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. Arresting mechanism for a coaxial plug connector composed of first and second plug connector halves that can be plugged together, an outside conductor sleeve of the first plug connector half provided with a surrounding groove in a front section on an outside surface thereof and the second plug connector half having a receiving space between an outside rigid protective sleeve and an outside conductor sleeve, into which the front section of the outside conductor sleeve of the first plug connector half can be inserted, at least one ball stored in a stepped radial boring of the protective sleeve being provided such that the ball can snap into the surrounding groove, when the first and second plug connector halves are assembled, comprising:

the stepped radial bore of the protective sleeve extending into a surrounding flat groove of the protective sleeve which is open towards the outside of the protective sleeve, and a circularly bent band spring contained in this flat groove, the band spring supporting itself at the ball and being interrupted at one location, the band spring being fastened in the flat groove only by means of two opposed indentations in opposite edges, respectively, of a border of the flat groove, the two opposed indentations being at the same circumferential location at one end of the band spring, and the one location of the interruption in the band spring being positioned in the flat groove relative to a location of the stepped radial bore and the indentations in the border of the flat groove being positioned relative to the location of the stepped radial bore such that a certain desired force is applied to the ball stored in the stepped radial bore.

2. Arresting mechanism for a coaxial plug connector composed of first and second plug connector halves, an outside conductor sleeve of the first plug connector half provided with a surrounding groove on an outside surface of a front section thereof and the second plug connector half having a receiving space between an outside rigid protective sleeve and an outside conductor sleeve, into which the front section of the outside conductor sleeve of the first plug connector half can be inserted, at least one stepped radial boring having a ball positioned therein and located in the protective sleeve such that the ball can snap into the surrounding groove, when the first and second plug connector halves are assembled, comprising:

an outer opening of the stepped radial bore of the protective sleeve interfacing with a circumferentially surrounding flat groove on an outer surface of the protective sleeve and a circularly bent band spring contained in the flat groove, the band spring supporting itself at the ball and being interrupted at one location, and the band spring being fastened in the flat groove by means of only two opposed indentations in opposite edges, respectively, of a border of the flat groove, the two opposed indentations being at the same circumferential location at one end of the band spring, and the one location of the interruption in the band spring being positioned in the flat groove relative to a location of the stepped radial bore and the indentations in the border of the flat groove being positioned relative to the location of the stepped radial bore such that a certain desired force is applied to the ball stored in the stepped radial bore.

3. Arresting mechanism for a coaxial plug connector composed of first and second plug connector halves, an outside conductor sleeve of the first plug connector half provided with a surrounding groove on an outside surface of a front section thereof and the second plug connector half having a receiving space between an outside rigid protective sleeve and an outside conductor sleeve, into which the front section of the outside conductor sleeve of the first plug connector half can be inserted, at least one stepped radial boring having a ball stored therein and located in the protective sleeve, the ball engaging the surrounding groove, when the first and second plug connector halves are assembled, comprising:

an outer opening of the stepped radial bore of the protective sleeve extending into an outward surrounding flat groove of the protective sleeve, and a band spring located in the flat groove, the band spring contacting the ball and being interrupted at one location, the band spring being fastened in the flat groove only by means of two opposed indentations in opposite edges, respectively, of a border of the flat groove, the two opposed indentations being at the same circumferential location at one end of the band spring, and the one location of the interruption in the band spring being positioned in the flat groove relative to a location of the stepped radial bore and the indentations in the border of the flat groove being positioned relative to the location of the stepped radial bore such that a certain desired force is applied to the ball stored in the stepped radial bore.

4. Arresting mechanism for a coaxial plug connector composed of first and second plug connector halves that can be plugged together, an outside conductor sleeve of the first plug connector half provided with a surrounding groove in a front section on an outside surface thereof and the second plug connector half having a receiving space between an outside rigid protective sleeve and an outside conductor sleeve, into which the front section of the outside conductor sleeve of the first plug connector half can be inserted, at least one ball stored in a stepped radial bore of the protective sleeve being provided such that the ball can snap into the surrounding groove, when the first and second plug connector halves are assembled, the stepped radial bore of the protective sleeve extending into a surrounding flat groove of the protective sleeve which is open toward the outside of the protective sleeve, and a circularly bent band spring contained in this flat groove, the band spring supporting itself at the ball and being interrupted at one location, comprising: the band spring being fastened in the flat groove only by means of two opposed indentations in opposite edges, respectively, of a border of the flat groove; and the two opposed indentations being at the same circumferential location at one end of the band spring.

5. Arresting mechanism according to claim 4, wherein the one location of the interruption in the band spring is positioned in the flat groove relative to a location of the stepped radial bore and the indentations in the border of the flat groove are positioned relative to the location of the stepped radial bore such that a certain desired force is applied to the ball stored in the stepped radial bore.

* * * * *